US009575447B2

(12) United States Patent
Ikebuchi et al.

(10) Patent No.: US 9,575,447 B2
(45) Date of Patent: Feb. 21, 2017

(54) FIXING DEVICE AND IMAGE FORMING APPARATUS

(71) Applicants: Yutaka Ikebuchi, Kanagawa (JP); Yasunori Ishigaya, Kanagawa (JP); Takuya Seshita, Kanagawa (JP); Kazuya Saito, Kanagawa (JP); Motoyoshi Yamano, Kanagawa (JP); Keitaro Shoji, Kanagawa (JP)

(72) Inventors: Yutaka Ikebuchi, Kanagawa (JP); Yasunori Ishigaya, Kanagawa (JP); Takuya Seshita, Kanagawa (JP); Kazuya Saito, Kanagawa (JP); Motoyoshi Yamano, Kanagawa (JP); Keitaro Shoji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/010,262

(22) Filed: Jan. 29, 2016

(65) Prior Publication Data

US 2016/0223964 A1 Aug. 4, 2016

(30) Foreign Application Priority Data

Feb. 4, 2015 (JP) ..... 2015-020393

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
CPC ..... G03G 15/2053; G03G 15/2064
USPC ..... 399/328, 329
See application file for complete search history.

(56) References Cited

U.S. PATENT DOCUMENTS

| | | | |
|---|---|---|---|
| 2007/0292175 | A1 | 12/2007 | Shinshi |
| 2011/0058866 | A1 | 3/2011 | Ishii et al. |
| 2011/0194869 | A1 | 8/2011 | Yoshinaga et al. |
| 2012/0114345 | A1 | 5/2012 | Fujimoto et al. |
| 2012/0121303 | A1 | 5/2012 | Takagi et al. |
| 2012/0121304 | A1 | 5/2012 | Tokuda et al. |
| 2013/0170880 | A1 | 7/2013 | Gotoh et al. |

(Continued)

FOREIGN PATENT DOCUMENTS

| | | |
|---|---|---|
| JP | 4-044083 | 2/1992 |
| JP | 2004-286922 | 10/2004 |

(Continued)

*Primary Examiner* — Hoang Ngo
(74) *Attorney, Agent, or Firm* — Oblon, McClelland, Maier & Neustadt, L.L.P.

(57) ABSTRACT

A fixing device includes a nip formation pad to form a fixing nip between a first fixing rotator and a second fixing rotator, through which a recording medium bearing a toner image is conveyed. The nip formation pad includes a first planar face, a second planar face disposed downstream from the first planar face in a recording medium conveyance direction and being parallel to the first planar face, and a joint face bridging the first planar face and the second planar face. The joint face includes a first curved portion adjoining the first planar face and having a first curvature in a first direction in which a circumferential face of the second fixing rotator is curved and a second curved portion adjoining the second planar face and having a second curvature in a second direction opposite the first direction.

20 Claims, 5 Drawing Sheets

(56) References Cited

U.S. PATENT DOCUMENTS

| | | | | |
|---|---|---|---|---|
| 2014/0341621 | A1* | 11/2014 | Omori ..... | G03G 15/2028 399/329 |
| 2015/0055993 | A1 | 2/2015 | Shoji | |
| 2015/0055994 | A1 | 2/2015 | Shoji et al. | |
| 2015/0110531 | A1 | 4/2015 | Takagi et al. | |
| 2015/0125193 | A1 | 5/2015 | Ishii et al. | |
| 2015/0261155 | A1 | 9/2015 | Yoshiura et al. | |
| 2015/0261157 | A1 | 9/2015 | Yamano et al. | |
| 2015/0268626 | A1 | 9/2015 | Saito et al. | |

FOREIGN PATENT DOCUMENTS

| | | |
|---|---|---|
| JP | 2005-221533 | 8/2005 |
| JP | 2007-233011 | 9/2007 |
| JP | 2007-334205 | 12/2007 |
| JP | 2014-134701 | 7/2014 |

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2015-020393, filed on Feb. 4, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a first fixing rotator, such as a fixing roller, a fixing belt, and a fixing film, heated by a heater and a second fixing rotator, such as a pressure roller and a pressure belt, pressed against the first fixing rotator to form a fixing nip therebetween through which a recording medium bearing a toner image is conveyed. As the recording medium bearing the toner image is conveyed through the fixing nip, the first fixing rotator and the second fixing rotator apply heat and pressure to the recording medium, melting and fixing the toner image on the recording medium.

SUMMARY

This specification describes below an improved fixing device. In one exemplary embodiment, the fixing device includes a flexible, first fixing rotator rotatable in a predetermined direction of rotation and a second fixing rotator disposed opposite the first fixing rotator and including an elastic layer. A heater heats one of the first fixing rotator and the second fixing rotator. A nip formation pad presses against the second fixing rotator via the first fixing rotator to form a fixing nip between the first fixing rotator and the second fixing rotator, through which a recording medium bearing a toner image is conveyed. The nip formation pad includes a first planar face, a second planar face disposed downstream from the first planar face in a recording medium conveyance direction and being parallel to the first planar face, and a joint face bridging the first planar face and the second planar face. The joint face includes a first curved portion adjoining the first planar face and having a first curvature in a first direction in which a circumferential face of the second fixing rotator is curved and a second curved portion adjoining the second planar face and having a second curvature in a second direction opposite the first direction.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a flexible, first fixing rotator rotatable in a predetermined direction of rotation and a second fixing rotator disposed opposite the first fixing rotator and including an elastic layer. A heater heats one of the first fixing rotator and the second fixing rotator. A nip formation pad presses against the second fixing rotator via the first fixing rotator to form a fixing nip between the first fixing rotator and the second fixing rotator, through which the recording medium bearing the toner image is conveyed. The nip formation pad includes a first planar face, a second planar face disposed downstream from the first planar face in the recording medium conveyance direction and being parallel to the first planar face, and a joint face bridging the first planar face and the second planar face. The joint face includes a first curved portion adjoining the first planar face and having a first curvature in a first direction in which a circumferential face of the second fixing rotator is curved and a second curved portion adjoining the second planar face and having a second curvature in a second direction opposite the first direction.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
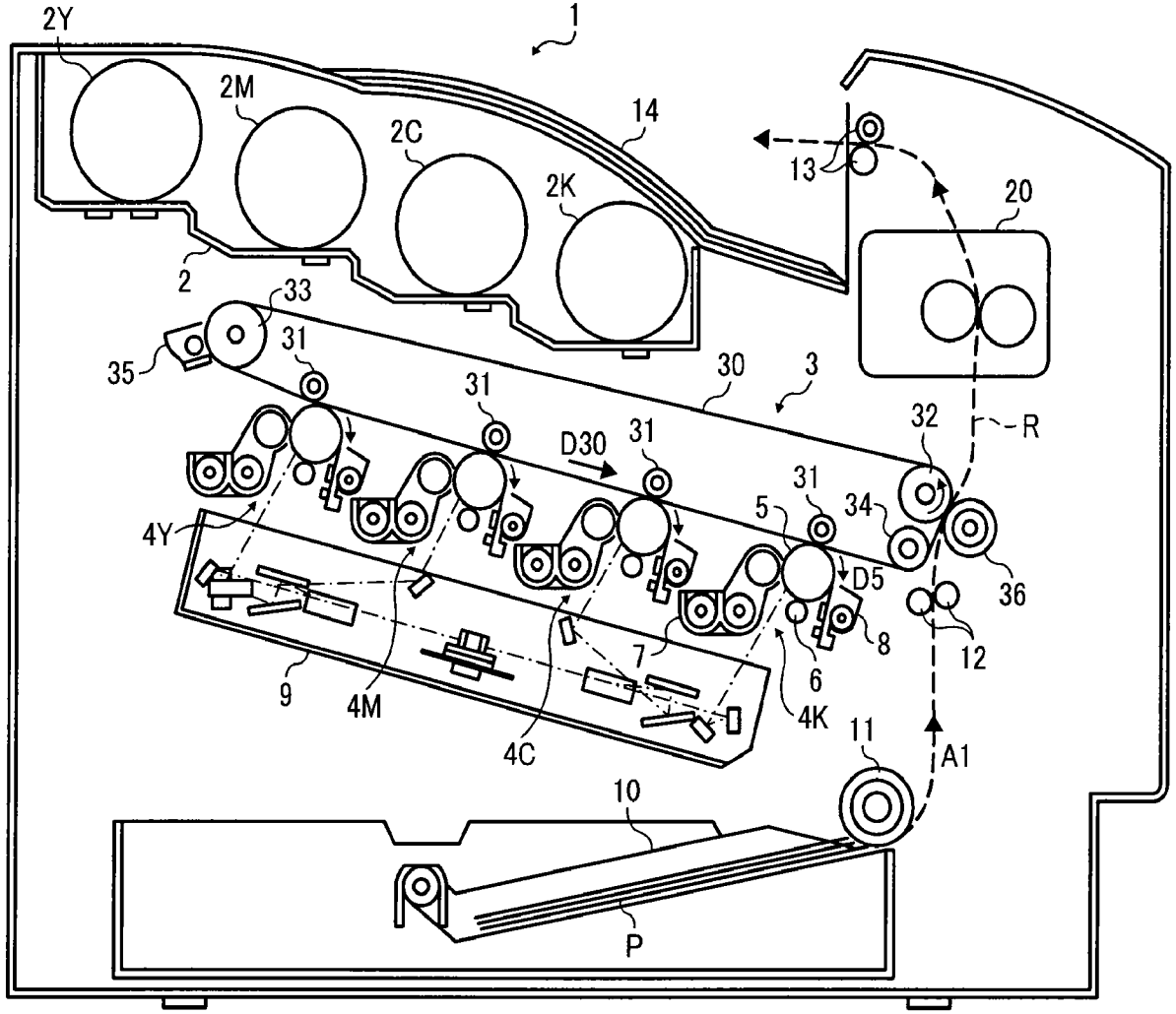
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on a recording medium by electrophotography. Alternatively, the image forming apparatus 1 may be a monochrome printer that forms a monochrome toner image on a recording medium.

It is to be noted that, in the drawings for explaining exemplary embodiments of this disclosure, identical reference numerals are assigned as long as discrimination is possible to components such as members and component parts having an identical function or shape, thus omitting description thereof once it is provided.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, they have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are connected to a power supply that applies a predetermined direct current (DC) voltage and/or alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current (DC) voltage and/or alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a timing roller pair conveys the sheet P conveyed from the feed roller 11 toward the secondary transfer nip at a proper time.

The conveyance path R is further provided with a fixing device 20 located above the secondary transfer nip, that is, downstream from the secondary transfer nip in the sheet conveyance direction A1. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

With reference to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 halts the sheet P temporarily.

Thereafter, the registration roller pair 12 resumes rotation at a predetermined time to convey the sheet P to the secondary transfer nip at a time when the full color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the full color toner image formed on the intermediate transfer belt 30, thus creating a transfer electric field at the secondary transfer nip. Thus, the yellow, magenta, cyan, and black toner images constituting the full color toner image are secondarily transferred from the intermediate transfer belt 30 onto the sheet P collectively by the transfer electric field created at the secondary transfer nip. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stacks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
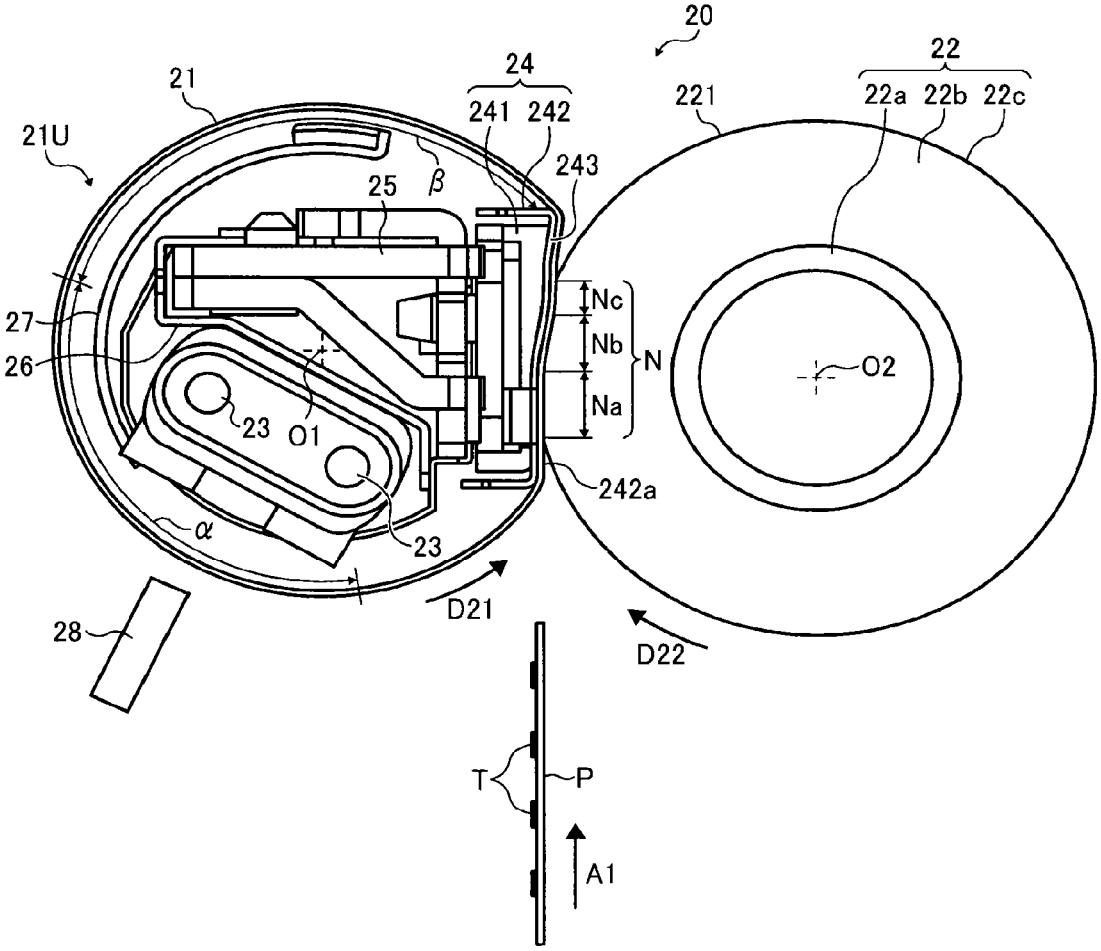
FIG. 2 is a schematic vertical sectional view of a fixing device incorporated in the image forming apparatus shown in FIG. 1.

With reference to FIG. 2, a description is provided of a construction of the fixing device 20 incorporated in the image forming apparatus 1 having the construction described above.

FIG. 2 is a schematic vertical sectional view of the fixing device 20. As shown in FIG. 2, the fixing device 20 (e.g., a fuser or a fusing unit) includes a fixing belt 21 serving as a first fixing rotator or an endless belt formed into a loop and rotatable in a rotation direction D21; a pressure roller 22 serving as a second fixing rotator disposed opposite an outer circumferential surface of the fixing belt 21 to separably or unseparably contact the fixing belt 21 and rotatable in a rotation direction D22 counter to the rotation direction D21 of the fixing belt 21; a halogen heater 23 serving as a heater or a heat source disposed inside the loop formed by the fixing belt 21 to heat the fixing belt 21; a nip formation pad 24 disposed inside the loop formed by the fixing belt 21 and pressing against the pressure roller 22 via the fixing belt 21 to form a fixing nip N between the fixing belt 21 and the pressure roller 22; a stay 25 serving as a support disposed inside the loop formed by the fixing belt 21 and contacting and supporting the nip formation pad 24; a reflector 26 disposed inside the loop formed by the fixing belt 21 to reflect light radiated from the halogen heater 23 toward the fixing belt 21; a heat shield 27 disposed inside the loop formed by the fixing belt 21 to shield the fixing belt 21 from the halogen heater 23; and a temperature sensor 28 serving as a temperature detector disposed opposite the outer circumferential surface of the fixing belt 21 to detect the temperature of the fixing belt 21. The fixing belt 21 and the components disposed inside the loop formed by the fixing belt 21, that is, the halogen heater 23, the nip formation pad 24, the stay 25, the reflector 26, and the heat shield 27, may constitute a belt unit 21U separably coupled with the pressure roller 22.

A detailed description is now given of a construction of the fixing belt 21.

The fixing belt 21 is a flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PT). The release layer is made of tetrafluoroethyl ene-perfluoroalkylvinyl ether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated quickly to a predetermined fixing temperature at which a toner image T is fixed on a sheet P. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T. To address this problem, it is preferable that the fixing belt 21 incorporates the elastic layer having a thickness not smaller than about 100 micrometers. The elastic layer having the thickness not smaller than 100 micrometers elastically deforms to absorb slight surface asperities of the fixing belt 21, preventing variation in gloss of the toner image T on the sheet P.

In order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm. Additionally, the loop diameter of the fixing belt 21 may not be greater than 30 mm.

According to this exemplary embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22.

A detailed description is now given of a configuration of a pair of belt holders 40 incorporated in the fixing device 20.

Figure 3:
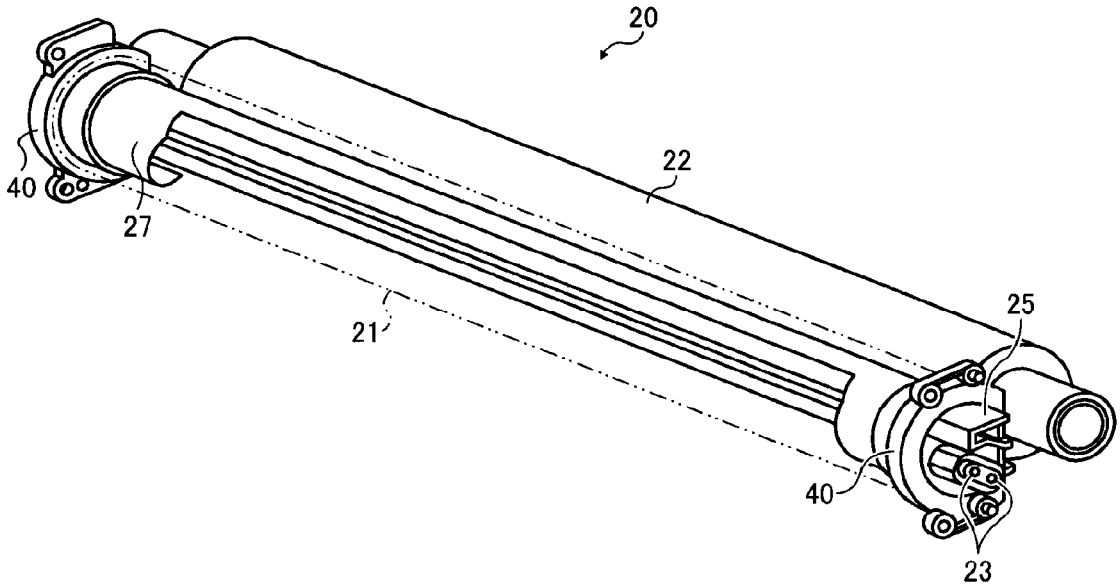
FIG. 3 is a partial perspective view of the fixing device shown in FIG. 2.

FIG. 3 is a partial perspective view of the fixing device 20. As shown in FIG. 3, the belt holders 40 are disposed opposite the inner circumferential surface of the fixing belt 21 at both lateral ends of the fixing belt 21 in an axial direction thereof, respectively. The belt holders 40 rotatably support the fixing belt 21. Basically, no other component supports the fixing belt 21. That is, the fixing belt 21 is not looped over or stretched taut across a roller or the like. The pair of belt holders 40, the halogen heater 23, and the stay 25 are mounted on and supported by a pair of side plates of the fixing device 20 disposed at both lateral ends of the fixing device 20 in the axial direction of the fixing belt 21, respectively.

A detailed description is now given of a construction of the pressure roller 22.

As shown in FIG. 2, the pressure roller 22 is constructed of a cored bar 22*a*; an elastic layer 22*b* coating the cored bar 22*a* and made of rubber such as silicone rubber foam, silicone rubber, and fluoro rubber; and a release layer 22*c* coating the elastic layer 22*b* and made of PFA, PTFE, or the like. A pressurization assembly presses the pressure roller 22 against the nip formation pad 24 via the fixing belt 21. The pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the sheet conveyance direction A1.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

According to this exemplary embodiment, the pressure roller 22 is a solid roller. Alternatively, the pressure roller 22 may be a hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21.

A detailed description is now given of a configuration of the halogen heater 23.

The halogen heater 23 is disposed opposite the inner circumferential surface of the fixing belt 21 and upstream from the fixing nip N in the sheet conveyance direction A1 so that the halogen heater 23 heats a circumferential span of the fixing belt 21 other than the fixing nip N in a circumferential direction, that is, the rotation direction D21, of the fixing belt 21. The power supply situated inside the image forming apparatus 1 supplies power to the halogen heater 23 so that the halogen heater 23 heats the fixing belt 21. A controller (e.g., a processor), that is, a central processing unit (CPU) provided with a random-access memory (RAM) and a read-only memory (ROM), for example, operatively connected to the halogen heater 23 and the temperature sensor 28 controls the halogen heater 23 based on the temperature of the surface of the fixing belt 21 detected by the temperature sensor 28. Thus, the temperature of the fixing belt 21 is adjusted to a desired fixing temperature. Instead of the temperature sensor 28 that detects the temperature of the fixing belt 21, a temperature sensor that detects the temperature of the pressure roller 22 may be disposed opposite the pressure roller 22 so that the temperature of the fixing belt 21 is estimated based on a temperature of the pressure roller 22 detected by the temperature sensor.

According to this exemplary embodiment, the fixing device 20 includes two halogen heaters 23. Alternatively, the fixing device 20 may include one halogen heater 23 or three or more halogen heaters 23 according to the sizes of the sheets P or the like available in the image forming apparatus 1. Alternatively, instead of the halogen heater 23, an induction heater (IH), a resistive heat generator, a carbon heater, or the like may be employed as a heater that heats the fixing belt 21.

A detailed description is now given of a configuration of the reflector 26.

The reflector 26 is mounted on and supported by the stay 25 such that the reflector 26 is disposed opposite the halogen heater 23. The reflector 26 reflects heat or light radiated from the halogen heater 23 toward the fixing belt 21, suppressing conduction of heat from the halogen heater 23 to the stay 25 and the like and thereby heating the fixing belt 21 effectively and saving energy. The reflector 26 is made of aluminum, stainless steel, or the like. If the reflector 26 is constructed of an aluminum base treated with vapor deposition of silver having a decreased emissivity and an increased reflectance, the reflector 26 enhances heating efficiency for heating the fixing belt 21.

A detailed description is now given of a configuration of the heat shield 27.

The heat shield 27 is manufactured by contouring a metal plate having a thickness in a range of from 0.1 mm to 1.0 mm into an arch in cross-section along the inner circumferential surface of the fixing belt 21. The heat shield 27 is interposed between the halogen heater 23 and the fixing belt 21 and movable in the circumferential direction of the fixing belt 21. According to this exemplary embodiment, as shown in FIG. 2, the fixing belt 21 has a circumferential heated span $\alpha$ and a circumferential non-heated span $\beta$ spanning in the circumferential direction thereof. The circumferential heated span $\alpha$ is disposed opposite the halogen heater 23 and heated directly by the halogen heater 23. The circumferential non-heated span $\beta$ is disposed opposite components (e.g., the reflector 26, the stay 25, and the nip formation pad 24) interposed between the halogen heater 23 and the fixing belt 21 and mounted on the side plates or the like and therefore is not heated by the halogen heater 23 directly. When the heat shield 27 is not requested to shield the fixing belt 21 from the halogen heater 23, the heat shield 27 moves to a retracted position where the heat shield 27 is disposed opposite the circumferential non-heated span $\beta$ of the fixing belt 21. Conversely, when the heat shield 27 is requested to shield the fixing belt 21 from the halogen heater 23, the heat shield 27 moves to a shield position where the heat shield 27 is disposed opposite the circumferential heated span $\alpha$ of the fixing belt 21.

As the heat shield 27 rotates, the heat shield 27 changes the area of the circumferential heated span $\alpha$ of the fixing belt 21, adjusting an amount of heat radiated from the halogen heater 23 to the fixing belt 21. For example, even if a plurality of small sheets P is conveyed over the fixing belt 21 continuously, the heat shield 27 prevents overheating of a non-conveyance span of the fixing belt 21 where the small sheets P are not conveyed over the fixing belt 21 and therefore do not draw heat from the fixing belt 21, thus preventing thermal degradation and damage of the fixing belt 21. Since the heat shield 27 is requested to be heat resistant, the heat shield 27 is made of metal such as aluminum, iron, and stainless steel or ceramic.

A detailed description is now given of a construction of the nip formation pad 24.

The nip formation pad 24 is disposed inside the loop formed by the fixing belt 21 and disposed opposite the pressure roller 22 via the fixing belt 21. The nip formation pad 24 includes a base 241 and a nip formation portion 242 mounted on a fixing nip side face of the base 241. The nip formation portion 242 is a thin plate. For example, each of the base 241 and the nip formation portion 242 is made of heat resistant resin such as polyether sulfone (PES), polyphenylene sulfide (PPS), liquid crystal polymer (LCP), polyether nitrile (PEN), polyamide imide (PAI), and polyether ether ketone (PEEK). Alternatively, each of the base 241 and the nip formation portion 242 may be made of metal or ceramic. The base 241 and the nip formation portion 242 may be made of different materials, respectively, or an identical material. If the base 241 and the nip formation portion 242 are made of the identical material, the base 241 and the nip formation portion 242 may be combined or molded into a single component.

The stay 25 supports the base 241 of the nip formation pad 24. Accordingly, even if the nip formation pad 24 receives pressure from the pressure roller 22, the nip formation pad 24 is not bent by the pressure and therefore produces a uniform nip length of the fixing nip N in the sheet conveyance direction A1 throughout the entire width of the fixing belt 21 and the pressure roller 22 in the axial direction thereof. The stay 25 is made of metal having an increased mechanical strength, such as steel (e.g., stainless steel), to prevent bending of the nip formation pad 24. Alternatively, the stay 25 may be made of resin having a mechanical strength great enough to prevent bending of the nip formation pad 24.

A slide face, that is, a front face described below, of the nip formation portion 242 over which the fixing belt 21 slides mounts a low-friction sheet 243. As the fixing belt 21 rotates in the rotation direction D21, the inner circumferential surface of the fixing belt 21 slides over the low-friction sheet 243 that reduces friction between the fixing belt 21 and the nip formation pad 24.

Figure 4:
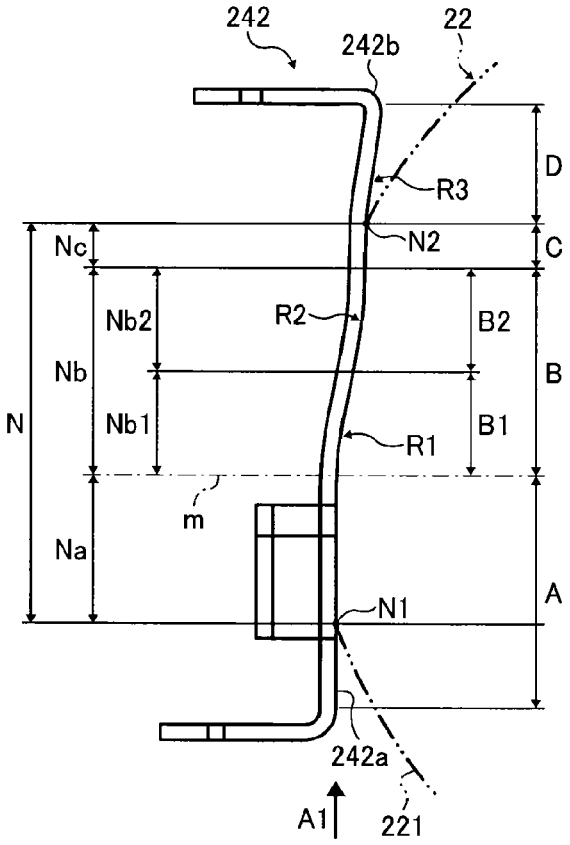
FIG. 4 is an enlarged sectional view of a nip formation portion incorporated in the fixing device shown in FIG. 2.

FIG. 4 is an enlarged sectional view of the nip formation portion 242. As shown in FIG. 4, the nip formation portion 242 includes a front face 242*a* disposed opposite the pressure roller 22. The front face 242*a* is greater than the fixing nip N in the sheet conveyance direction A1. The front face 242*a* includes a first planar face A, a joint face B, a second planar face C, and a guide face D arranged in this order in the sheet conveyance direction A1 from an entry N1 to the fixing nip N, that is, a lower part of the fixing nip N in FIG. 4, through which the sheet P enters the fixing nip N.

The two planar faces, that is, the first planar face A and the second planar face C, are parallel to each other. The first planar face A is disposed upstream from the second planar face C in the sheet conveyance direction A1 to define the entry N1 to the fixing nip N. The second planar face C is disposed downstream from the first planar face A in the sheet conveyance direction A1 to define an exit N2 of the fixing nip N through which the sheet P is ejected from the fixing nip N. The second planar face C is closer to the pressure roller 22 than the first planar face A is. That is, the second planar face C is situated rightward in FIG. 4 compared to the first planar face A. The first planar face A and the second planar face C are parallel to the sheet conveyance direction A1 in which the sheet P enters the entry N1 to the fixing nip N. For example, according to this exemplary embodiment, a rotation axis O1 of the fixing belt 21 depicted in FIG. 2 coincides with an axis of the belt holder 40 depicted in FIG. 3. The rotation axis O1 of the fixing belt 21 and a rotation axis O2 of the pressure roller 22 define a hypothetical line m depicted in FIG. 4. The first planar face A and the second planar face C are aligned along a direction substantially perpendicular to the hypothetical line m.

The first planar face A merges smoothly with the second planar face C through the joint face B without a sharp edge between the first planar face A and the second planar face C. The joint face B includes a first curved portion B1 that adjoins the first planar face A and a second curved portion B2 that adjoins the second planar face C. The first curved portion B1 has a first curvature in a first direction identical to a direction in which a circumferential face 221, that is, an outer circumferential surface, of the pressure roller 22 depicted in FIG. 2 is curved. Conversely, the second curved portion B2 has a second curvature in a second direction opposite the first direction in which the circumferential face 221 of the pressure roller 22 is curved. In other words, the first curved portion B1 is recessed relative to the pressure roller 22. Conversely, the second curved portion B2 projects toward the pressure roller 22. The first planar face A adjoins the first curved portion B1 to share a common tangent. The second planar face C adjoins the second curved portion B2 to share a common tangent.

According to this exemplary embodiment, the first curved portion B1 defines a cylindrical surface having a single radius of curvature R1. The second curved portion B2 defines a cylindrical surface having a single radius of curvature R2. The first curvature of the first curved portion B1, preferably a curvature of the first curved portion B1 and the second curved portion B2, is greater than a curvature of the circumferential face 221 at a curved portion of the pressure roller 22 in a circumferential direction thereof that is not disposed opposite the fixing nip N. Alternatively, one or both of the first curved portion B1 and the second curved portion B2 may define a non-cylindrical curved surface produced by combining a plurality of cylindrical surfaces having different radii of curvature, respectively.

The first curved portion B1 adjoins the second curved portion B2 such that the first curved portion B1 and the second curved portion B2 share a common tangent. Alternatively, the first curved portion B1 may merge with the second curved portion B2 through a planar face, a curved face, or a complex face defined by combining the planar face and the curved face. The number of the planar faces and the curved faces is arbitrary.

The guide face D is contoured or shaped arbitrarily. For example, the guide face D may be a planar face, a curved face, or a complex face defined by combining the planar face and the curved face. The number of the planar faces and the curved faces is arbitrary. The guide face D has a single radius of curvature R3. The guide face D defines a cylindrical surface curved in the direction identical to the direction in which the circumferential face 221 of the pressure roller 22 is curved. The guide face D is recessed relative to the pressure roller 22. The guide face D and the second planar face C share a common tangent.

As shown in FIG. 2, as the pressure roller 22 is pressed against the nip formation portion 242 of the nip formation pad 24 via the fixing belt 21, the elastic layer 22*b* of the pressure roller 22 is deformed elastically to form the fixing nip N between the pressure roller 22 and the fixing belt 21. As shown in FIG. 4, since the second planar face C projects toward the pressure roller 22 or rightward in FIG. 4 farther than the first planar face A, the entry N1 to the fixing nip N and the first planar face A are exerted with decreased pressure from the pressure roller 22. Conversely, the exit N2 of the fixing nip N and the second planar face C are exerted with increased pressure from the pressure roller 22. As shown in FIG. 2, the low-friction sheet 243 is sandwiched between the fixing belt 21 and the front face 242*a* of the nip formation portion 242. As the pressure roller 22 is driven and rotated in the rotation direction D22, the fixing belt 21 slides over the front face 242*a* of the nip formation portion 242 via the low-friction sheet 243 while the fixing belt 21 is deformed along the front face 242*a* of the nip formation portion 242. As described above, since the front face 242*a* of the nip formation portion 242 has a smooth surface without an edge, the front face 242*a* prevents the nip formation portion 242 from being exerted with increased pressure from the pressure roller 22 locally, improving durability of the fixing belt 21 and the low-friction sheet 243.

As shown in FIG. 4, the first planar face A and the second planar face C of the nip formation portion 242 define a plane of the fixing nip N contoured along the first planar face A and the second planar face C. The joint face B of the nip formation portion 242 defines a curved surface of the fixing nip N contoured along the joint face B. The first planar face A of the nip formation portion 242 defines a first planar portion Na of the fixing nip N. The joint face B of the nip formation portion 242 defines a joint portion Nb of the fixing nip N. The second planar face C of the nip formation portion 242 defines a second planar portion Nc of the fixing nip N. The joint portion Nb includes a first joint portion Nb1 defined by the first curved portion B1 and a second joint portion Nb2 defined by the second curved portion B2.

The first planar portion Na includes the entry N1 to the fixing nip N. That is, the first planar face A of the nip formation portion 242 defines the entry N1 to the fixing nip N through which the sheet P enters the fixing nip N. Conversely, the second planar portion Nc includes the exit N2 of the fixing nip N. That is, the second planar face C of the nip formation portion 242 defines the exit N2 of the fixing nip N through which the sheet P is ejected from the fixing nip N. A length of the second planar portion Nc is smaller than a length of the first planar portion Na in the sheet conveyance direction A1.

Figure 5:
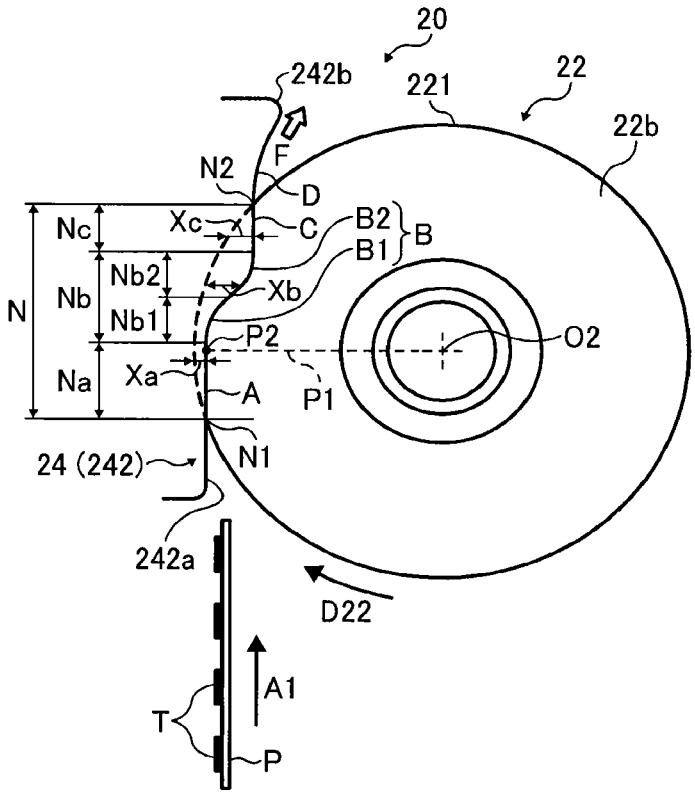
FIG. 5 is a partial schematic vertical sectional view of the fixing device shown in FIG. 2 illustrating a fixing nip formed by the nip formation portion shown in FIG. 4.

FIG. 5 is a partial schematic vertical sectional view of the fixing device 20 illustrating the fixing nip N formed by the nip formation portion 242 described above. FIG. 5 exaggerates projection of the second planar face C relative to the first planar face A of the nip formation pad 24 to clarify the shape of the fixing nip N. Hence, the shape of the front face 242*a* of the nip formation portion 242 and the fixing nip N is practically different from the shape thereof illustrated in FIG. 5. FIG. 5 does not illustrate the fixing belt 21 to simplify the drawing.

The sheet P conveyed in the sheet conveyance direction A1 in a state in which the toner image T formed on the sheet P faces the fixing belt 21 reaches the entry N1 to the fixing nip N and enters the first planar portion Na of the fixing nip N. The first planar portion Na produces a compression rate Xa of the elastic layer 22*b* of the pressure roller 22 that increases gradually from an upstream section to a downstream section of the first planar portion Na in the sheet conveyance direction A1. Accordingly, pressure exerted to the sheet P increases gradually as the sheet P moves from the upstream section to the downstream section of the first planar portion Na in the sheet conveyance direction A1. Thereafter, the sheet P is conveyed through the first joint portion Nb1 and enters the second joint portion Nb2. The first joint portion Nb1 and the second joint portion Nb2 produce a compression rate Xb of the elastic layer 22*b* of the pressure roller 22 that increases gradually from the first joint portion Nb1 to the second joint portion Nb2 in the sheet conveyance direction A1. The compression rate Xb is maximized at the second joint portion Nb2 and therefore the sheet P is exerted with maximum pressure or increased pressure as the sheet P moves through the second joint portion Nb2.

According to this exemplary embodiment, since the first joint portion Nb1 of the fixing nip N contoured by the first curved portion B1 of the joint face B defines a cylindrical surface, the sheet P is exerted with pressure that increases gradually from the first joint portion Nb1 to the second joint portion Nb2 that achieves the maximum pressure or the increased pressure exerted to the sheet P, thus reducing stress imposed on the sheet P. The first curvature of the first curved portion B1 is greater than the curvature of the circumferential face 221 of the pressure roller 22, suppressing sharp increase in the compression rate between the first joint portion Nb1 and the second joint portion Nb2 and thereby reducing stress imposed on the sheet P further.

Thereafter, the sheet P moves through the second planar portion Nc of the fixing nip N. While the sheet P moves through the second planar portion Nc of the fixing nip N in the sheet conveyance direction A1, the compression rate Xb of the elastic layer 22*b* of the pressure roller 22 decreases gradually from an upstream section to a downstream section of the second planar portion Nc in the sheet conveyance direction A1. Hence, pressure exerted to the sheet P decreases gradually. Accordingly, a fixing process involving melting, fluidization, combination, permeation, and solidification of toner of the toner image T is mainly performed while the sheet P moves through the joint portion Nb and the second planar portion Nc.

When the sheet P reaches the exit N2 of the fixing nip N, the guide face D of the nip formation pad 24 directs and ejects the sheet P in a direction F tilted slightly toward the pressure roller 22 relative to an extension direction of the second planar portion Nc. The sheet P comes into contact with a separation claw that separates the sheet P from the fixing belt 21. A downstream end of the front face 242*a* of the nip formation portion 242 in the sheet conveyance direction A1 adjoins a round portion 242*b* having a decreased radius of curvature. The round portion 242*b* having an increased curvature bends the fixing belt 21 in a direction in which the fixing belt 21 separates from the pressure roller 22, thus facilitating separation of the sheet P ejected from the fixing nip N from the fixing belt 21.

As described above, the second joint portion Nb2 and the second planar portion Nc of the fixing nip N that increase pressure exerted to the sheet P are disposed in proximity to the exit N2 of the fixing nip N. In order to attain such pressure distribution, a portion of the fixing nip N that maximizes or increases the compression rate of the elastic layer 22*b* of the pressure roller 22, that is, the joint portion Nb or the second joint portion Nb2 of the joint portion Nb of the fixing nip N which is defined by the joint face B or the second curved portion B2 of the nip formation pad 24 according to this exemplary embodiment, is disposed in proximity to the exit N2 of the fixing nip N and downstream from the rotation axis O2 of the pressure roller 22 in the sheet conveyance direction A1. For example, the rotation axis O2 of the pressure roller 22 and the first planar face A of the nip formation portion 242 or an extension of the first planar face A define a perpendicular P1. The perpendicular P1 intersects the first planar face A at an intersection P2. The second joint portion Nb2 is downstream from the intersection P2 and upstream from the exit N2 of the fixing nip N in the sheet conveyance direction A1.

As shown in FIG. 4, according to this exemplary embodiment, a boundary between the first planar portion Na and the joint portion Nb is disposed in proximity to the hypothetical line m defined by the rotation axis O1 of the fixing belt 21 and the rotation axis O2 of the pressure roller 22. Accordingly, the second joint portion Nb2 that maximizes or increases the compression rate Xb of the elastic layer 22*b* of the pressure roller 22 is disposed downstream from the rotation axis O2 of the pressure roller 22 in the sheet conveyance direction A1 and upstream from the exit N2 of the fixing nip N in the sheet conveyance direction A1 precisely.

A description is provided of a configuration of a first comparative fixing device incorporating a first comparative nip formation pad pressing against a pressure roller via a fixing belt to form a fixing nip between the fixing belt and the pressure roller. The first comparative nip formation pad includes an upstream face and a downstream face that contact the fixing belt. The upstream face disposed upstream from the downstream face in a rotation direction of the fixing belt has a curvature in a direction identical to a direction in which a circumferential face of the pressure roller is curved. The downstream face has a curvature in a direction opposite the direction of the curvature of the upstream face. The curvature of the downstream face is greater than the curvature of the upstream face.

A description is provided of a configuration of a second comparative fixing device incorporating a second comparative nip formation pad pressing against a pressure roller via a fixing belt to form a fixing nip between the fixing belt and the pressure roller.

The second comparative nip formation pad includes an upstream face and a downstream face that contact the fixing belt. The upstream face disposed upstream from the downstream face in a rotation direction of the fixing belt defines a projecting curve projecting toward the pressure roller. Conversely, the downstream face defines shapes other than the projecting curve such as a recessed curve and a plane.

However, the upstream face of the first comparative nip formation pad, that is situated at and in proximity to an entry to the fixing nip and curved along the circumferential face of the pressure roller, may crease an outer circumferential surface of the fixing belt that comes into contact with a sheet conveyed through the fixing nip. While the sheet is conveyed over the upstream face, toner of a toner image on the sheet may be melted insufficiently and therefore the toner of the toner image may be adhered to the sheet insufficiently. Accordingly, the creased fixing belt may peel the toner off the sheet or drop the toner from the sheet, degrading quality of the toner image formed on the sheet.

On the other hand, the upstream face of the second comparative nip formation pad that defines the projecting curve projecting toward the pressure roller may increase a differential between a linear velocity of the pressure roller and a linear velocity of the fixing belt. Additionally, the upstream face of the second comparative nip formation pad may press against and deform the pressure roller with increased pressure. Accordingly, the sheet bearing toner melted insufficiently while the sheet is conveyed over the upstream face of the second comparative nip formation pad may be exerted with a substantial shift force that shifts the toner of the toner image from a proper position on the sheet, resulting in degradation in quality of the toner image formed on the sheet.

A description is provided of advantages of the fixing device 20 having the construction described above with reference to FIGS. 2, 4, and 5.

The fixing belt 21 contoured along the first planar portion Na of the fixing nip N is less susceptible to creasing on the surface of the fixing belt 21 compared to the fixing belt 21 contoured into a recess relative to the pressure roller 22. The first planar portion Na that achieves the decreased compression rate Xa of the elastic layer 22*b* of the pressure roller 22 decreases a linear velocity differential between a linear velocity of the fixing belt 21 and a linear velocity of the pressure roller 22. Since the first planar portion Na decreases pressure exerted to the sheet P from the pressure roller 22, the first planar portion Na exerts a decreased shift force to the unfixed toner image T on the sheet P that may shift the unfixed toner image T from a proper position on the sheet P. Accordingly, the first planar portion Na situated at an upstream section of the fixing nip N in the sheet conveyance direction A1 suppresses shifting of the unfixed toner image T from the proper position on the sheet P, thus preventing fixing failure that may degrade quality of the toner image T fixed on the sheet P.

Since the second planar face C of the nip formation pad 24 projects toward the pressure roller 22 farther than the first planar face A, at least the joint portion Nb situated downstream from the first planar portion Na in the sheet conveyance direction A1, that is, the joint portion Nb or the joint portion Nb and the second planar portion Nc, attains a compression rate of the elastic layer 22*b* of the pressure roller 22 that is greater than the compression rate Xa attained by the first planar portion Na. Accordingly, the joint portion Nb or the joint portion Nb and the second planar portion Nc situated in proximity to the exit N2 of the fixing nip N increase pressure exerted to the sheet P. Consequently, the toner image T is applied with heat and pressure sufficiently and fixed on the sheet P precisely. Thus, the nip formation pad 24 increases pressure exerted to the sheet P at the fixing nip N locally, suppressing an amount of heat generated by the halogen heater 23 and saving energy.

As described above, the first planar portion Na of the fixing nip N where the unfixed toner image T on the sheet P is heated insufficiently and therefore is susceptible to shifting from the proper position on the sheet P is planar and projects toward the pressure roller 22 to press against the elastic layer 22*b* with a decreased pressing amount, thus suppressing shifting of the unfixed toner image T from the proper position on the sheet P. Conversely, the joint portion Nb and the second planar portion Nc of the fixing nip N where the unfixed toner image T on the sheet P is heated sufficiently project toward the pressure roller 22 to press against the elastic layer 22*b* with an increased pressing amount, thus fixing the toner image T on the sheet P precisely. Accordingly, the nip formation pad 24 prevents fixing failure that may degrade quality of the toner image T formed on the sheet P while attaining stable fixing.

If a fixing device includes a first roller pressed against a second roller to form a fixing nip therebetween, the fixing nip is contoured into a curved recess or a curved projection in cross-section. Accordingly, when an envelope is used as a sheet P, the envelope may be conveyed at different linear velocities between a front side and a back side of the envelope and therefore may suffer from creasing. To address this circumstance, the fixing device 20 according to this exemplary embodiment includes the nip formation pad 24 that produces the first planar portion Na disposed at the entry N1 to the fixing nip N and the second planar portion Nc disposed at the exit N2 of the fixing nip N. The first planar portion Na is parallel to the second planar portion Nc and leveled uneven with the second planar portion Nc in a direction perpendicular to the sheet conveyance direction A1. Accordingly, a first bend direction in which the envelope is bent while the envelope is conveyed through the first planar portion Na and the joint portion Nb is opposite a second bend direction in which the envelope is bent while the envelope is conveyed through the joint portion Nb and the second planar portion Nc, offsetting bending of the envelope in the first bend direction with bending of the envelope in the second bend direction. No portion of the fixing nip N other than the first planar portion Na, the joint portion Nb, and the second planar portion Nc bends the envelope, preventing creasing of the envelope.

Figure 6:
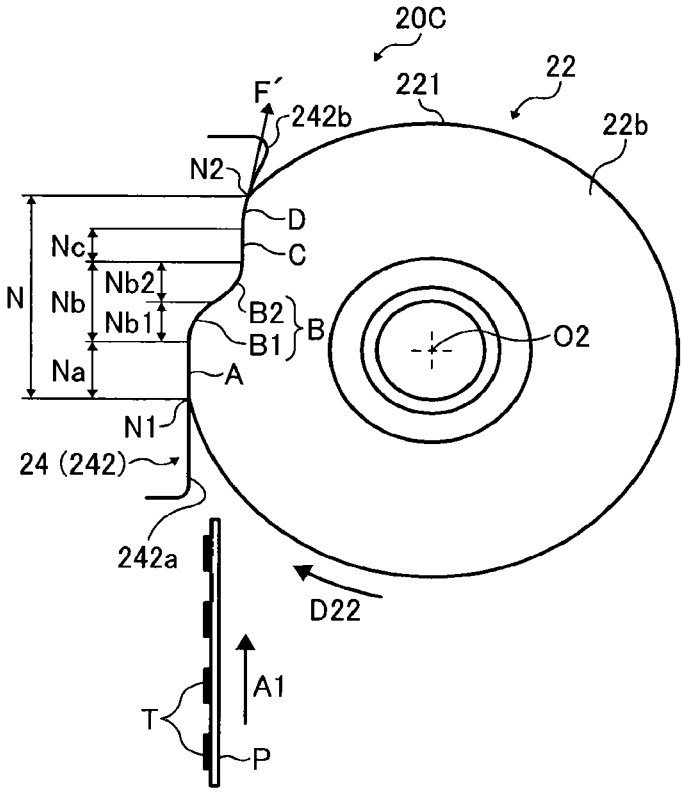
FIG. 6 is a partial vertical sectional view of a comparative fixing device.

The second planar face C of the nip formation pad 24 defines the exit N2 of the fixing nip N to direct and eject the sheet P in a constant direction even if the length of the fixing nip N in the sheet conveyance direction A1 changes slightly. FIG. 6 is a partial vertical sectional view of a third comparative fixing device 20C. As shown in FIG. 6, if the exit N2 of the fixing nip N is tilted relative to the second planar portion Nc, for example, if the guide face D of the nip formation portion 242 defines the exit N2, as the length of the fixing nip N in the sheet conveyance direction A1 changes, an ejection direction F' in which the sheet P is ejected from the fixing nip N may vary, degrading decurling. To address this circumstance, the fixing device 20 shown in FIG. 5 incorporates the nip formation pad 24 including the second planar portion Nc that defines the exit N2 of the fixing nip N. Accordingly, the sheet P is ejected from the fixing nip N in a straight ejection direction defined by the second planar portion Nc.

As shown in FIG. 4, a downstream end of the second planar face C in the sheet conveyance direction A1 defines the exit N2 of the fixing nip N. Alternatively, in order to prevent variation in the ejection direction F' caused by change in the length of the fixing nip N in the sheet conveyance direction A1 described above, the downstream end of the second planar face C in the sheet conveyance direction A1 may be disposed downstream from the exit N2 of the fixing nip N, that is, outside the fixing nip N, in the sheet conveyance direction A1.

A description is provided of a construction of a fixing device 20S according to another exemplary embodiment.

Figure 7:
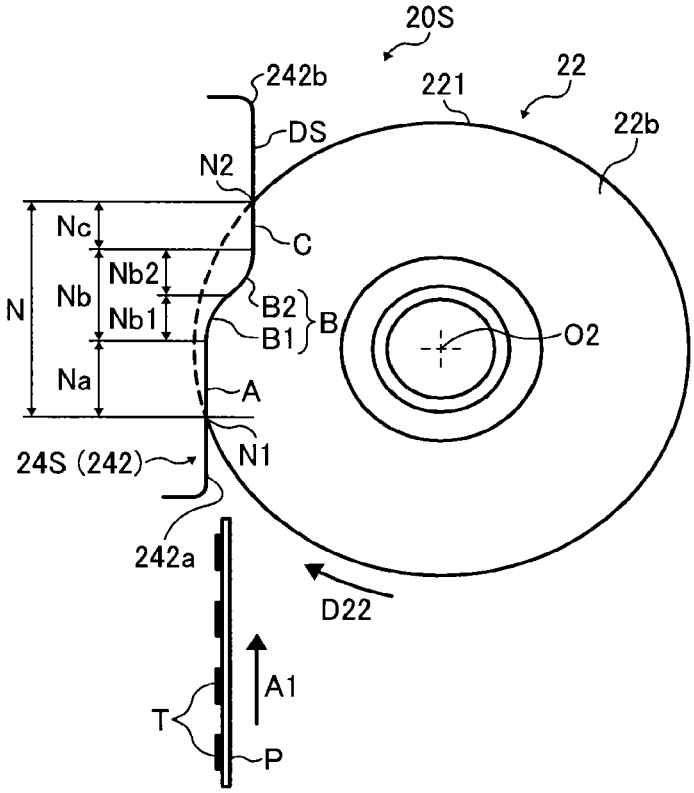
FIG. 7 is a partial schematic vertical sectional view of a fixing device according to another exemplary embodiment of the present disclosure.

FIG. 7 is a partial schematic vertical sectional view of the fixing device 20S. In the fixing device 20 according to the exemplary embodiment described above with reference to FIGS. 2, 4, and 5, the guide face D of the nip formation pad 24 is recessed relative to the pressure roller 22 to define a cylindrical surface. Conversely, the fixing device 20S (e.g., a fuser or a fusing unit) shown in FIG. 7 includes a nip formation pad 24S including a planar guide face DS that shares an identical plane with the second planar face C. Accordingly, even if the length of the fixing nip N in the sheet conveyance direction A1 varies in an increased span and the guide face DS is anticipated to define the fixing nip N, the guide face DS stabilizes an ejection direction of the sheet P in which the sheet P is ejected from the fixing nip N.

A description is provided of a construction of a fixing device 20T according to yet another exemplary embodiment.

Figure 8:
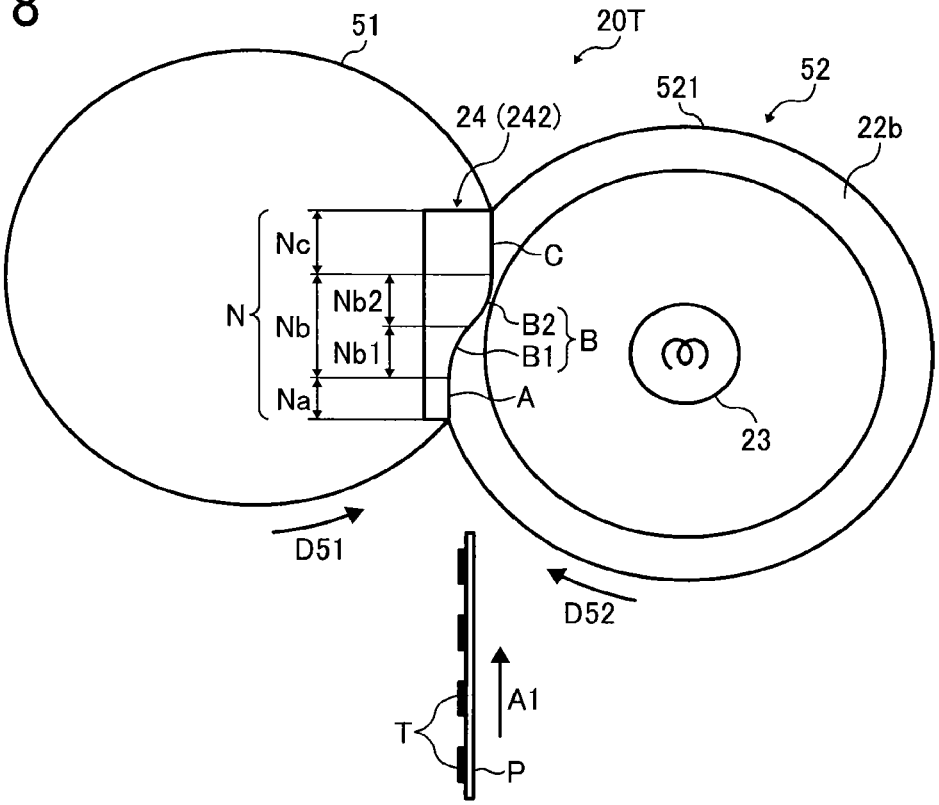
FIG. 8 is a schematic vertical sectional view of a fixing device according to yet another exemplary embodiment of the present disclosure.

FIG. 8 is a schematic vertical sectional view of the fixing device 20T. The fixing device 20 depicted in FIG. 2 incorporates the halogen heater 23 disposed inside the loop formed by the fixing belt 21 to heat the fixing belt 21. Conversely, the fixing device 20T depicted in FIG. 8 incorporates the halogen heater 23 disposed inside a fixing roller 52 including the elastic layer 22*b* to heat the fixing roller 52. FIG. 8 illustrates an example of the halogen heater 23 situated inside the fixing roller 52, not inside a loop formed by an endless belt 51.

As shown in FIG. 8, the fixing device 20T (e.g., a fuser or a fusing unit) includes the flexible endless belt 51 serving as a first fixing rotator or a first fixing member formed into a loop and rotatable in a rotation direction D51 and the fixing roller 52 serving as a second fixing rotator or a second fixing member rotatable in a rotation direction D52 and including the elastic layer 22*b*. As the fixing roller 52 is pressed against the nip formation pad 24 disposed inside the loop formed by the endless belt 51 via the endless belt 51, the elastic layer 22*b* of the fixing roller 52 is deformed elastically to form the fixing nip N between the fixing roller 52 and the endless belt 51. The halogen heater 23 is disposed inside the fixing roller 52 to heat the fixing roller 52. As a sheet P bearing an unfixed toner image T is conveyed through the fixing nip N, the fixing roller 52 heated by the halogen heater 23 and the endless belt 51 fix the toner image T on the sheet P under heat and pressure.

The nip formation pad 24 includes the first planar face A, the second planar face C parallel to the first planar face A, and the joint face B bridging the first planar face A and the second planar face C. The joint face B includes the first curved portion B1 and second curved portion B2. The first curved portion B1 adjoins the first planar face A and has a first curvature in a first direction in which a circumferential face 521, that is, an outer circumferential surface, of the fixing roller 52 is curved such that the first curved portion B1 is curved along the circumferential face 521 of the fixing roller 52. The second curved portion B2 adjoins the second planar face C and has a second curvature in a second direction opposite the first direction such that the second curved portion B2 projects toward the circumferential face 521 of the fixing roller 52. Accordingly, the fixing device 20T attains advantages similar to the advantages attained by the fixing device 20 shown in FIG. 2.

The present disclosure is not limited to the details of the exemplary embodiments described above and various modifications and improvements are possible.

A description is provided of advantages of the fixing devices 20, 20S, and 20T.

As shown in FIGS. 2, 7, and 8, each of the fixing devices 20, 20S, and 20T includes a flexible, first fixing rotator (e.g., the fixing belt 21 and the endless belt 51), an elastic, second fixing rotator (e.g., the pressure roller 22 and the fixing roller 52), a nip formation pad (e.g., the nip formation pads 24 and 24S), and a heater (e.g., the halogen heater 23). The first fixing rotator is rotatable in a predetermined direction of rotation (e.g., the rotation directions D21 and D51). The second fixing rotator includes the elastic layer 22*b* and is disposed opposite the first fixing rotator. The second fixing rotator is rotatable in a predetermined direction of rotation (e.g., the rotation directions D22 and D52). The nip formation pad presses against the second fixing rotator via the first fixing rotator to form the fixing nip N between the first fixing rotator and the second fixing rotator. As a recording medium (e.g., a sheet P) bearing a toner image T is conveyed through the fixing nip N, the first fixing rotator and the second fixing rotator fix the toner image T on the recording medium.

As shown in FIGS. 5, 7, and 8, the nip formation pad includes the first planar face A, the second planar face C parallel to the first planar face A, and the joint face B bridging the first planar face A and the second planar face C. The first planar face A, the joint face B, and the second planar face C define the fixing nip N in a recording medium conveyance direction (e.g., the sheet conveyance direction A1). The second planar face C is disposed downstream from the first planar face A in the recording medium conveyance direction and defines the exit N2 of the fixing nip N through which the recording medium is ejected from the fixing nip N. The joint face B includes the first curved portion B1 and the second curved portion B2. The first curved portion B1 adjoins the first planar face A and has a first curvature in a first direction in which a circumferential face (e.g., the circumferential faces 221 and 521) of the second fixing rotator is curved. For example, the first curved portion B1 is curved along or recessed relative to the circumferential face of the second fixing rotator. The second curved portion B2 adjoins the second planar face C and has a second curvature in a second direction opposite the first direction. For example, the second curved portion B2 projects toward the circumferential face of the second fixing rotator.

That is, the first curved portion B1 has a curve corresponding to a curve of the circumferential face of the second fixing rotator. The second curved portion B2 has a curve opposite the curve of the circumferential face of the second fixing rotator. Accordingly, the second planar face C projects toward the circumferential face of the second fixing rotator relative to the first planar face A. Consequently, the entry N1 to the fixing nip N that is defined by the first planar face A is exerted with decreased pressure from the second fixing rotator. Conversely, the exit N2 of the fixing nip N that is defined by the second planar face C is exerted with increased pressure from the second fixing rotator.

As shown in FIG. 5, the first planar face A of the nip formation pad defines the planar entry N1 to the fixing nip N and the first planar portion Na of the fixing nip N. Accordingly, the first planar face A suppresses creasing of an outer circumferential surface of the first fixing rotator. The first planar portion Na that achieves the decreased compression rate Xa of the elastic layer 22*b* of the second fixing rotator decreases a linear velocity differential between a linear velocity of the first fixing rotator and a linear velocity of the second fixing rotator. Since the first planar portion Na decreases pressure exerted to the recording medium from the second fixing rotator, the first planar portion Na exerts a decreased shift force to a developer (e.g., toner) of the unfixed toner image T on the recording medium that may shift the unfixed toner image T from a proper position on the recording medium. That is, the first planar portion Na decreases the shift force exerted to the developer at the entry N1 to the fixing nip N and the first planar face A of the fixing nip N where the developer is melted insufficiently, thus decreasing the shift force that may shift the unfixed toner image T from the proper position on the recording medium and thereby preventing degradation in quality of the toner image T fixed on the recording medium.

Conversely, the joint face B defines the joint portion Nb of the fixing nip N and the second planar face C defines the second planar portion Nc of the fixing nip N. The joint portion Nb and the second planar portion Nc are situated in proximity to the exit N2 of the fixing nip N and increase pressure exerted to the recording medium. Accordingly, the developer of the toner image T is applied with heat and pressure sufficiently and fixed on and adhered to the recording medium precisely. Consequently, the nip formation pad prevents fixing failure that may degrade quality of the toner image T formed on the recording medium while attaining stable fixing.

According to the exemplary embodiments described above, the fixing belt 21 and the endless belt 51 serve as a first fixing rotator. Alternatively, a fixing film, a fixing sleeve, or the like may be used as a first fixing rotator. Further, the pressure roller 22 and the fixing roller 52 serve as a second fixing rotator. Alternatively, a pressure belt or the like may be used as a second fixing rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a flexible, first fixing rotator rotatable in a predetermined direction of rotation;

a second fixing rotator disposed opposite the first fixing rotator and including an elastic layer;

a heater to heat one of the first fixing rotator and the second fixing rotator; and a nip formation pad to press against the second fixing rotator via the first fixing rotator to form a fixing nip between the first fixing rotator and the second fixing rotator, the fixing nip through which a recording medium bearing a toner image is conveyed, the nip formation pad including:

a first planar face;

a second planar face disposed downstream from the first planar face in a recording medium conveyance direction, being parallel to the first planar face, and having a length shorter than a length of the first planar face in the recording medium conveyance direction; and a joint face bridging the first planar face and the second planar face, the joint face including:

a first curved portion adjoining the first planar face and having a first curvature in a first direction in which a circumferential face of the second fixing rotator is curved; and a second curved portion adjoining the second planar face and having a second curvature in a second direction opposite the first direction.

2. The fixing device according to claim 1, wherein the first planar face, the joint face, and the second planar face are arranged in the recording medium conveyance direction to define the fixing nip.

3. The fixing device according to claim 1, wherein the first curvature of the first curved portion is greater than a third curvature of the circumferential face of the second fixing rotator.

4. The fixing device according to claim 1, wherein the first planar face adjoins the first curved portion to share a first common tangent and the second planar face adjoins the second curved portion to share a second common tangent.

5. The fixing device according to claim 1, wherein the first curved portion adjoins the second curved portion to share a third common tangent.

6. The fixing device according to claim 1, wherein each of the first curved portion and the second curved portion defines a cylindrical surface.

7. The fixing device according to claim 1, wherein the first planar face defines an entry to the fixing nip through which the recording medium enters the fixing nip.

8. The fixing device according to claim 1, wherein the second planar face defines an exit of the fixing nip through which the recording medium is ejected from the fixing nip.

9. The fixing device according to claim 1, wherein the second curved portion is disposed downstream from a rotation axis of the second fixing rotator in the recording medium conveyance direction to increase a compression rate of the elastic layer of the second fixing rotator.

10. The fixing device according to claim 1, wherein the first curved portion is curved along the circumferential face of the second fixing rotator.

11. The fixing device according to claim 1, wherein the first curved portion is recessed relative to the circumferential face of the second fixing rotator and the second curved portion projects toward the circumferential face of the second fixing rotator.

12. The fixing device according to claim 1, wherein the nip formation pad further includes a guide face adjoining and being disposed downstream from the second planar face in the recording medium conveyance direction, the guide face to direct the recording medium toward the second fixing rotator.

13. The fixing device according to claim 12, wherein the guide face is recessed relative to the second fixing rotator.

14. The fixing device according to claim 12, wherein the guide face is planar to share an identical plane with the second planar face.

15. The fixing device according to claim 1, wherein the first planar face and the second planar face are aligned along a direction substantially perpendicular to a hypothetical line defined by a rotation axis of the first fixing rotator and a rotation axis of the second fixing rotator.

16. The fixing device according to claim 15, wherein the rotation axis of the second fixing rotator and the first planar face of the nip formation pad define a line that is perpendicular to the first planar face at an intersection, and wherein the second curved portion is downstream from the intersection in the recording medium conveyance direction.

17. The fixing device according to claim 1, wherein the nip formation pad further includes a round portion disposed downstream from the second planar face in the recording medium conveyance direction, the round portion having an increased curvature to bend the first fixing rotator in a direction in which the first fixing rotator separates from the second fixing rotator.

18. The fixing device according to claim 1, wherein the first fixing rotator includes an endless belt and the second fixing rotator includes a roller.

19. The fixing device according to claim 1, wherein the length of the first planar face is longer than a length of the first curved portion in the recording medium conveyance direction.

20. An image forming apparatus comprising:

an image forming device to form a toner image; and a fixing device disposed downstream from the image forming device in a recording medium conveyance direction to fix the toner image on a recording medium, the fixing device including:

a flexible, first fixing rotator rotatable in a predetermined direction of rotation;

a second fixing rotator disposed opposite the first fixing rotator and including an elastic layer;

a heater to heat one of the first fixing rotator and the second fixing rotator; and a nip formation pad to press against the second fixing rotator via the first fixing rotator to form a fixing nip between the first fixing rotator and the second fixing rotator, the fixing nip through which the recording medium bearing the toner image is conveyed, the nip formation pad including:

a first planar face;

a second planar face disposed downstream from the first planar face in the recording medium conveyance direction, being parallel to the first planar face, and having a length shorter than a length of the first planar face in the recording medium conveyance direction; and a joint face bridging the first planar face and the second planar face, the joint face including:

a first curved portion adjoining the first planar face and having a first curvature in a first direction in which a circumferential face of the second fixing rotator is curved; and a second curved portion adjoining the second planar face and having a second curvature in a second direction opposite the first direction.

* * * * *